United States Patent [19]

Schmidt et al.

[11] Patent Number: 4,461,132

[45] Date of Patent: Jul. 24, 1984

[54] SUB-STRUCTURE FOR BOAT DOCKS

[75] Inventors: Richard O. Schmidt, Prairie Village; Ace E. King, Leawood, both of Kans.

[73] Assignee: Steel-N-Foam Docks, Inc., Kansas City, Kans.

[21] Appl. No.: 238,220

[22] Filed: Feb. 26, 1981

[51] Int. Cl.[3] ..... E04C 2/38

[52] U.S. Cl. ..... 52/656; 52/690; 405/218

[58] Field of Search ..... 52/648, 656, 690; 405/218, 219

[56] References Cited

U.S. PATENT DOCUMENTS 3,279,141 10/1966 Schmidt ..... 52/656

FOREIGN PATENT DOCUMENTS 720994 11/1965 Canada ..... 52/656

*Primary Examiner*—John Murtagh

*Assistant Examiner*—Kathryn L. Ford

*Attorney, Agent, or Firm*—John A. Hamilton

[57] ABSTRACT

A sub-structure for boat docks consisting of an elongated, ladder-like frame having a pair of side bars connected by a series of cross bars extending between and connected at their ends to the side bars, the side bars and cross bars being of such cross-sectional configuration, and the connections therebetween being of such a nature, that the frame may yield in a vertical direction with relatively great resilient flexibility, whereby to accomodate wave action in the water therebeneath, while at the same time being relatively highly resistant to deformation in its own plane for maintaining its horizontal form and shape. Generally, the side and cross bars are of such configuration as to strongly resist bending stresses, but to permit torsional yielding with relative ease, and the cross bars are connected to the side bars to permit a degree of universal pivotal movement therebetween.

1 Claim, 4 Drawing Figures

SUB-STRUCTURE FOR BOAT DOCKS

This invention relates to new and useful improvements in sub-structures for boat docks, and is an improvement over the structure shown in prior U.S. Pat. No. 3,279,141, issued Oct. 18, 1966. Said sub-structure, as here concerned, is the frame of a buoyant dock which is supported by the flotation elements of said dock, and which in turn supports the decking or flooring of the dock.

The principal object of the invention in the prior patent above referred to was the provision of a dock sub-structure, or frame, which while quite rigid in a horizontal plane, was relatively flexible in a vertical direction. The vertical yieldability permitted it to yield in response to water waves passing thereunder. The water wave would be duplicated, to a reduced scale, in the frame. This has been found to produce a more durable, longer lived dock, more free of damage often caused by storms and rough water, than can be produced by building a frame which is extremely strong and rigid, in the same manner that a tree resists damage by high winds by bending and yielding to the wind, rather than rigidly resisting it. On the other hand, the horizontal rigidity is necessary if the dock is to retain its shape and structural integrity. The object of the present invention is generally the same, but with the provision of means supplying still greater vertical yieldability, with little or no sacrifice of horizontal rigidity. More specifically, while both the prior patent and the present invention envision dock frames of the same general arrangement, and side and cross bars of the same cross-sectional configurations, the present invention provides an improved connection of the cross bars to the side bars which imparts a greater degree of universal pivotability therebetween.

More specifically, while both forms of the invention require pivotal attachment of each end of each cross bar to a horizontally yieldable portion of the associated side bar, the prior patent utilized six bolts distributed over a substantial length of the side bar, thereby causing undesired rigidity of connection and inhibiting the desired pivotal yielding, the present invention provides a connection utilizing only two bolts disposed in a vertical line, which provides minimum rigidity and maximum yieldability.

Other objects are simplicity and economy of structure, efficiency and dependability of operation, and adaptability to be furnished in small basic units, which may be assembled to provide composite docks of any desired size or design.

Figure 1:
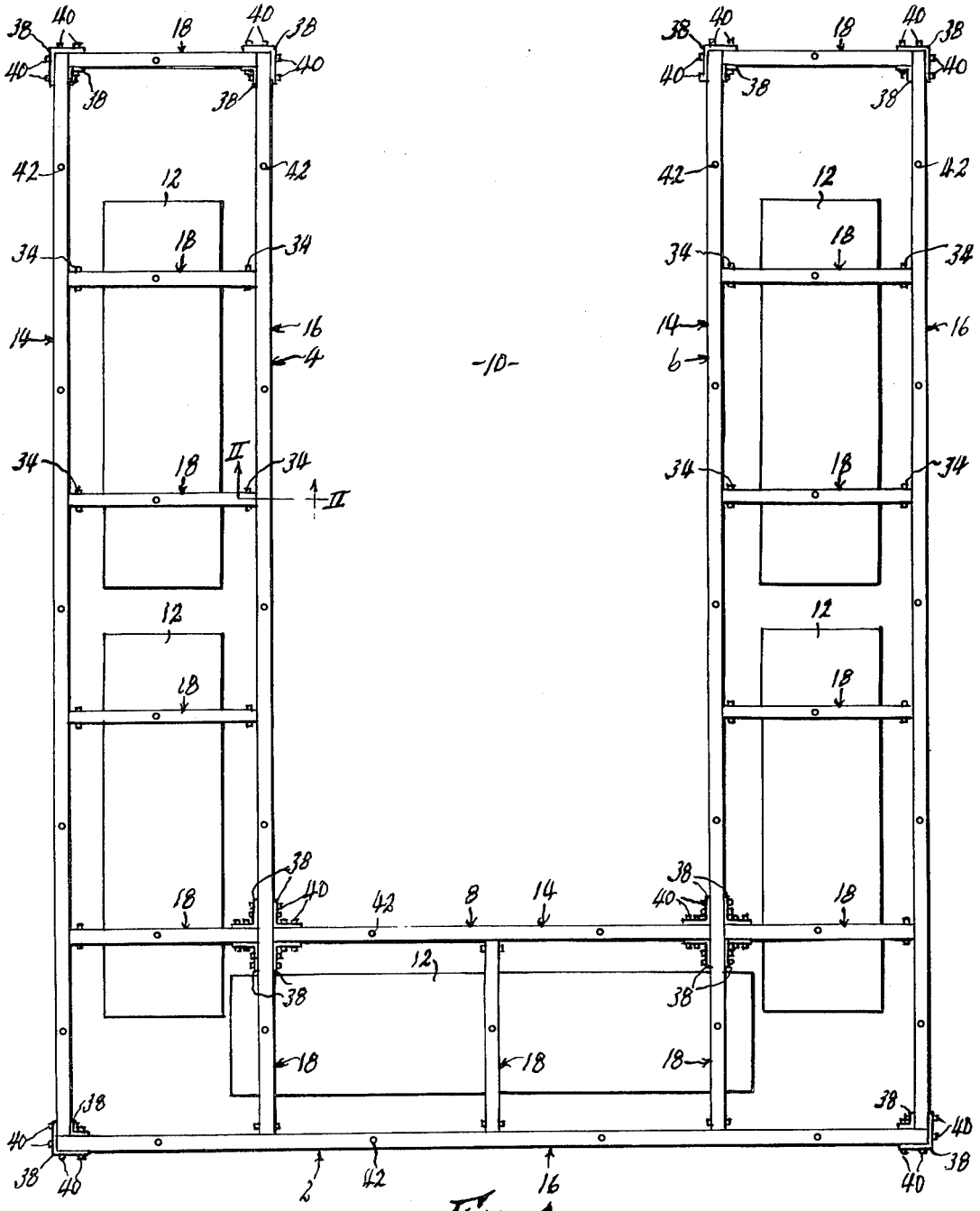
Figure 2:
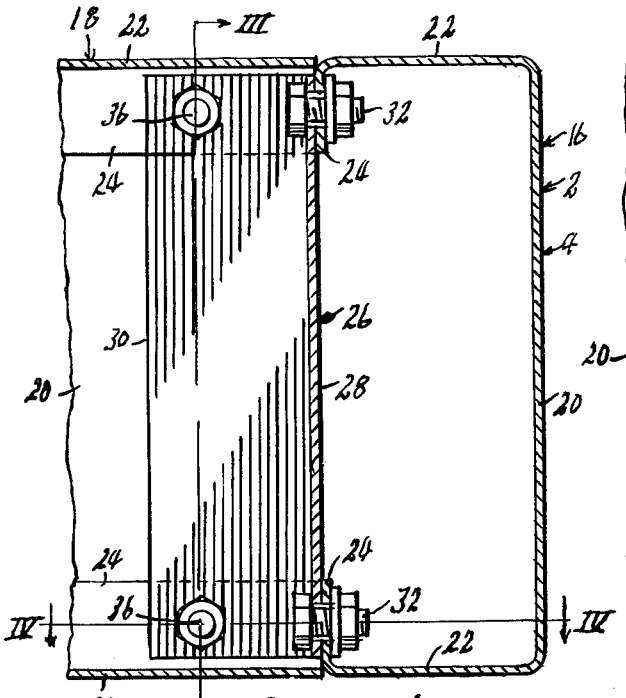
Figure 3:
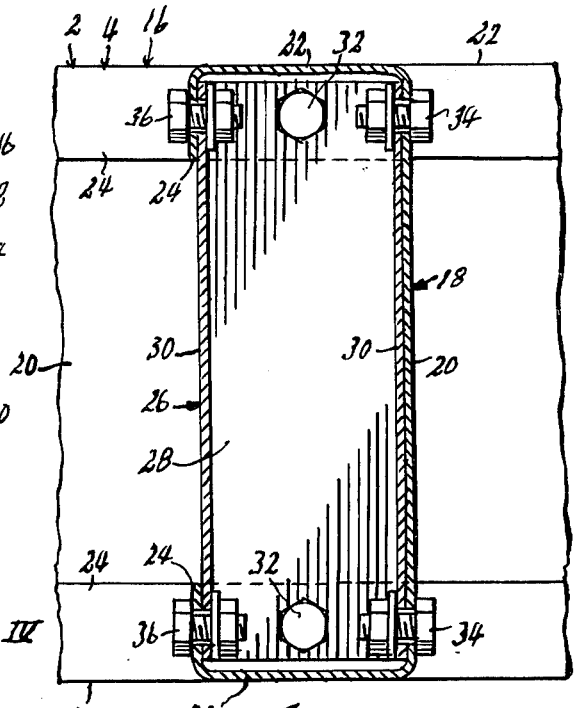
Figure 4:
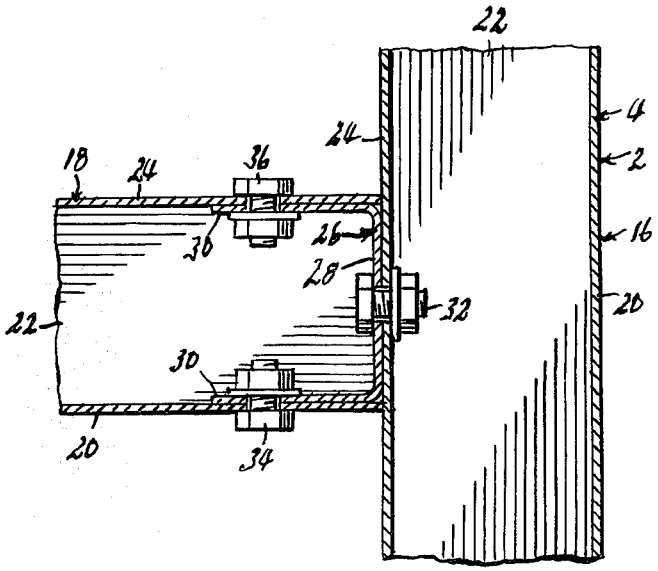

With these objects in view, as well as other objects which will appear in the course of the specification, reference will be had to the accompanying drawing, wherein:

FIG. 1 is a top plan view of a boat dock including a sub-structure embodying the present invention, with the decking removed to show the sub-structure, FIG. 2 is an enlarged, fragmentary sectional view taken on line II—II of FIG. 1, FIG. 3 is a fragmentary sectional view taken on line III—III of FIG. 2, and FIG. 4 is a fragmentary sectional view taken on line IV—IV of FIG. 2.

Like reference numerals apply to similar parts throughout the several views, and the numeral 2 applies generally to a boat dock sub-structure embodying the present invention, said sub-structure consisting of a plurality of sections 4, 6 and 8 arranged generally in a U-shape lying horizontally, section 8 forming the base of the U and sections 4 and 6 extending in parallel, spaced apart relation from the opposite ends of section 8 to form a boat well 10 therebetween. This is, of course, only one possible arrangement of the sections. By using any desired number of sections, and assembling them as desired, docks of nearly any desired shape can be produced. For example, straight docks of any desired length can be produced by assembling sections in end-to-end relation, and boats simply secured alongside, or a long central section can be used with multiple right-angled sections extending from either or both sides thereof to define a large number of boat wells. However, the specific arrangement of the sections is not particularly pertinent to the present invention, and except for minor details, the principle of the invention will be apparent from a description of the structure and function of a single section, as will appear below. The sub-structure is floated in the water by large flotation blocks 12 of buoyant material such as synthetic foam, attached to the lower surface thereof by any suitable means, not shown, and it will of course be understood that the sub-structure as shown is normally covered by decking, such as wood planks.

Each of sections 4, 6 and 8 is ladder-like in form, consisting of a pair of parallel side bars 14 and 16 connected at intervals along their lengths by a series of parallel, spaced apart cross bars 18 disposed at right angles to said side bars. The principal features of operation of the sub-structure result from the configuration of said side bars and cross bars, and in their mode of attachment to each other, and the present invention resides in improvements in said attachments. As best shown in FIGS. 2–4, each of said side bars and cross bars is formed of sheet metal, preferably steel having a substantial degree of resilience, and is in the form of a C-shaped channel having a main web 20, a pair of parallel flanges 22 extending from the opposite edges of said main web, and an inturned lip 24 at the free edge of each of said flanges. This configuration renders the side and cross bars extremely resistant to general bending flexure, their strength in this respect approaching that of box beams, but leaves them relatively free to twist about their longitudinal axes, for a purpose which will presently appear.

The cross bars 18, except for those at the ends of any section, extend between and abut the side bars 14 and 16 at their respective ends, and each end of each cross bar is secured to the associated side bar by a vertical connector channel designated generally by the numeral 26, said channel being of U-form and having a base web portion 28 and flanges 30 extending in parallel, spaced apart relation from the edges of said base web portion. Said channel extends vertically, and is of such size as to fit snugly inside the end of the cross bar, with base portion 28 thereof flush with the end of the cross bar and normal to the general extent of the cross bar, and with flanges 30 thereof extending into the cross bar, and respectively abutting the inner surfaces of main web 20 and lips 24 of the cross bar, as best shown in FIG. 4. Base 28 of the channel abuts the lipped edge of the associated side bar, and is affixed along its vertical midline to each of the lips of the side bar by a single bolt 32. One of the flanges 30 of the channel is affixed to main web 30 of the cross bar by bolts 34, and the other flange 30 of the channel is affixed to each of the lips 24 of the cross bar by a bolt 36. One of the bolts 34 and one of bolts 36 lie in a common horizontal plane with each of bolts 32, whereby to transmit stresses applied to bolts 34 and 36 by the cross bar directly to bolts 32 and thence to lips 24.

It will be seen that the above described connection permits a limited degree of universal movement between each of the cross bars and the side bars to which it is attached. That is, due to the resilient yieldability of the lips 24 of the side bars, the cross bar may to a limited extent "pivot" both horizontally and vertically relative to the side bars to which it is attached. This pivotal movement is rendered easier and is increased, as compared to the prior patent above referred to, by the fact that the cross bar has only a single point connection (bolt 32) to each lip 24 of the side bar, which concentrates the stresses on said lips normally to their planes to provide easier vertical "pivotal" movement of the cross bar, and that the two bolts 32 are disposed in a vertical line at the midline of base web 28, and midway of the thickness of the cross bar in a direction parallel to the side bars, which permits easier horizontal "pivoting" of the cross bar. This distinguishes the connection from that shown in said prior patent, wherein each cross bar is secured to each side bar by a pair of vertically extending sheet metal angles fitted into each of the internal angles therebetween, and bolted to each lip of the side bar by a series of bolts distributed along a substantial length of said lips. The described connection, by yielding of lips 24 inwardly of the frame, also permits the transverse spacing between the cross bars to be varied, by increasing said spacing either at the top or bottom planes of the frame, as occurs when the side bars are subjected to torsional strains in a manner to be described.

With the structure thus far described, each of the sections 4, 6 and 8 could be relatively easily deformed in a horizontal plane by relative longitudinal movement between the two side bars 14 and 16 thereof, as permitted by the "pivotal" connection of the cross bars thereto. Such deformation would of course be objectionable as destroying the ability of the section to retain its desired horizontal configuration in rough water. Particularly at the juncture of different sections, such as the junctures of sections 4 and 6 with section 8, such deformation would allow variations in the relative horizontal angularity between contiguous sections, which would impair the horizontal configuration of boat well 10. To prevent this, the connections between cross bar 18 and the side bars at the free end of any section, and at the juncture of any two sections, are stiffened by fitting a vertically extending sheet metal angle 38 (see FIG. 1) into each internal angle between the cross bars and side bars at these points, and around the outside of any external angle between said side and cross bars, and securely affixing said angles both to the main webs and the lips of said side and cross bars by bolts 40. This stiffening means is used in said prior patent, and effectively retains the dock in its general horizontal shape. The sub-structure frame is of course normally covered by decking, not shown, such as wood planking or the like. The upper flanges of side bars 14 and 16 are provided with bolt holes 42 for receiving bolts to secure the decking in place. It is important that said decking, as well as flotation blocks 12, and their connections to the frame, be sufficiently flexible not to interfere with the described vertical flexibility of the sub-structure.

In use, it will be seen that if a water wave passes under the dock, that portion of the sub-structure directly above the wave will be free to yield resiliently upwardly independently of other portions of the dock. Considering one section of the sub-structure, this vertical yieldability of selective portions thereof is not obtained by general bending flexure of the side bars, since as previously described said side bars are highly resistant to this type of flexure. Rather, it is obtained by a torsional twisting of said side bars about their longitudinal axes, to which they have relatively low resistance, it being apparent that if a C-channel as shown is strained torsionally about its longitudinal axis, it tends to assume a "corkscrew" configuration, so that portions thereof may be disposed at a higher elevation than other portions. Moreover, the upward pressure of water at any point along the length of the dock automatically forces that portion of the side rails into the "corkscrew" twist just described, and as a wave traverses the length of a dock section, the undulation of side bars 14 and 16 moves accordingly. In actual observation tests, as a wave traverses the length of a dock section as just described, a corresponding though reduced undulation of the top surface of the dock is easily observable with the naked eye.

The corkscrew twisting of side bars 14 and 16 as just described results in slight changes of angularity, both horizontally and vertically, between said side bars and cross bars 18, and these changes are permitted by the universally yieldable connections between said side and cross bars, as provided by channels 26, bolts 32, and the yieldability of side bar lips 24. This connection is considered to be a substantial improvement over that shown in the referenced prior patent, in that it provides a greater yieldability, hence contributing to a greater vertical flexibility of the sub-structure, with less damaging strains and stresses on the connected parts. If a wave moves angularly to the general extent of the dock, the point of maximum deflection of one side bar will not correspond to the point of maximum deflection of the other side bar, and a torsional twisting strain will be exerted on cross bars 18 as well as the side bars. For this reason, the cross bars are preferably formed of C-channel to be torsionally yieldable, just as are the side bars.

It is important that the side bars 14 and 16 open toward each other in opposed relation, rather than opening in the same direction, since if they opened in the same direction, upward pressure at one point thereof, as by a wave, would tend to twist both side bars in the same direction, and this would cause a slight angling of the section in a horizontal plane. With the side bars opposed as shown, they tend to twist in opposite directions, and any tendency of one side bar to angle horizontally is counteracted by an opposite tendency of the other side bar, and the section remains straight as viewed from above. The side bars must open inwardly rather than outwardly, although the latter would also provide opposite twisting thereof, in order to dispose the flexible lips 24 thereof for connection to the cross bars.

The actual movements of the side and cross bars are extremely complex and difficult to analyze and describe with complete accuracy, but it is believed that the structure and operation thereof will be clear from the foregoing description. Generally, the substance of the invention is the provision of a boat dock sub-structure having improved vertical flexibility for better resisting rough water damage thereto by yielding resiliently to vertical stresses applied thereto by rough water, rather than by resisting such stresses rigidly, while still maintaining rigidity of the dock in a horizontal plane, so that even complex docks with many boat wells will retain their designed shapes indefinitely.

While we have shown and described a specific embodiment of our invention, it will be readily apparent that many minor changes of structure and operation could be made without departing from the spirit of the invention.

What we claim as new and desire to protect by Letters Patent is:

1. A sub-structure for boat docks comprising an elongated frame of generally ladder-like form and adapted to be float-supported in a generally horizontal plane, said frame comprising:

a. a pair of parallel, spaced apart side bars formed of resilient sheet metal, said side bars being of C-channel form in cross-sectional contour and opening toward each other, each having a vertical main web, horizontal flanges at the upper and lower edges of said main web, and an inturned vertical lip at the free edge of each of said flanges, whereby to be relatively highly resistant to bending flexure but relatively less resistant to torsional strain, b. a series of cross bars extending between said side bars in parallel, spaced apart relation, each of said cross bars being of a C-shaped channel form the same as that of said side bars, with its open side facing horizontally, c. means connecting each end of each of said cross bars to its associated side bar and comprising a vertically extending metal channel closing the end portion of the hollow cross-sectional contour of the cross bar, having a base web disposed flush with the end of the cross bar, normal to the general extent thereof, and abutting the lips of the associated side bar, and a pair of spaced apart parallel flanges abutting respectively the main web and lips of said cross bar, means affixing the flanges of said connector channel respectively to the main web and lips of said cross bar, and a single horizontal bolt affixing the base web of said connector channel to each of the lips of said side bar, said bolts being disposed at the vertical midline of said base web portion, and d. means connecting said side bars to resist relative longitudinal movement thereof strongly, whereby to maintain the generally rectangular form of said frame.

* * * * *